US012584651B2

(12) United States Patent
Radonich

(10) Patent No.: US 12,584,651 B2
(45) Date of Patent: Mar. 24, 2026

(54) VENT

(71) Applicant: I.N. Vent Products LLC, San Jose, CA (US)

(72) Inventor: Ronald Allen Radonich, San Jose, CA (US)

(73) Assignee: I.N. Vent Products LLC, San Jose, CA (US)

( * ) Notice: Subject to any disclaimer, the term of this patent is extended or adjusted under 35 U.S.C. 154(b) by 789 days.

(21) Appl. No.: 17/889,741

(22) Filed: Aug. 17, 2022

(65) Prior Publication Data

US 2023/0054154 A1 Feb. 23, 2023

Related U.S. Application Data

(60) Provisional application No. 63/234,172, filed on Aug. 17, 2021.

(51) Int. Cl.
*F24F 13/08* (2006.01)

(52) U.S. Cl.
CPC ..... *F24F 13/082* (2013.01)

(58) Field of Classification Search
CPC ..... F24F 13/082; F24F 7/02; F24F 2221/52; E04D 1/30; E04D 13/17
USPC ..... 454/284
See application file for complete search history.

(56) References Cited

U.S. PATENT DOCUMENTS

| | | | | |
|---|---|---|---|---|
| 7,137,224 | B2 * | 11/2006 | Rasmussen | E04D 13/152 52/95 |
| 2012/0304567 | A1 * | 12/2012 | Baker, IV | F24F 7/02 52/302.1 |
| 2020/0200411 | A1 * | 6/2020 | Daniels | E04D 1/30 |
| 2022/0205254 | A1 * | 6/2022 | McDow, Jr. | E04F 17/04 |

* cited by examiner

*Primary Examiner* — Steven B Mcallister
*Assistant Examiner* — Charles R Brawner
(74) *Attorney, Agent, or Firm* — Zilka-Kotab, P.C.

(57) ABSTRACT

A vent providing excellent airflow and water intrusion resistance in a compact design.

19 Claims, 13 Drawing Sheets

VENT

RELATED APPLICATION

This application claims priority to U.S. Provisional Patent Appl. No. 63/234,172 filed Aug. 17, 2021, which is herein incorporated by reference.

FIELD OF THE INVENTION

The present invention relates to ventilation, and more particularly, this invention relates to a vent configured to maximize airflow therethrough while resisting water intrusion.

BACKGROUND

It is often desirable to provide venting on homes, buildings, and other structures to allow the ingress and egress of air for such reasons as humidity control, heat exchange, and other well-known reasons. However, one recurring issue is that of water intrusion, especially for venting designed for the upside of a roof. At one extreme, an open hole provides unfettered ventilation but no protection from water intrusion; while at the other extreme, a sealed vent provides waterproofing but no ventilation. Products currently on the market attempt to create a balance between ventilation and water intrusion, but have been found to sacrifice one of the desired characteristics for the other. Unfortunately, no product heretofore created has been able to provide excellent ventilation characteristics along with excellent water resistance, especially in a low-profile design.

SUMMARY

A vent according to one embodiment includes a lower panel having a front edge and a back edge. An upper panel is spaced from the lower panel, the upper panel having at least one array of apertures therethrough. A face panel extends between the lower and upper panels in a direction from the front edge of the lower panel toward the back edge of the lower panel. Walls extend between the lower and upper panels, the walls defining inner channels and outer channels therebetween, the walls having openings therein. The lower panel includes at least one airflow hole therethrough, the airflow hole extending along and being generally aligned with longitudinal axes of the inner channels.

A vent according to another embodiment includes a lower panel having a front edge and a back edge. An upper panel is spaced from the lower panel, the upper panel having arrays of apertures therethrough aligned in rows, the rows extending in a direction between the front and back edge of the lower panel. A face panel extends between the lower and upper panels in the direction from the front edge of the lower panel toward the back edge of the lower panel. Walls extend between the lower and upper panels, the walls defining inner channels and outer channels therebetween, the walls having openings therein. The outer channels are positioned below and are aligned with the arrays of apertures, wherein longitudinal axes of the outer channels extend along longitudinal axes of the arrays of apertures. The lower panel includes airflow holes therethrough, the airflow holes extending along longitudinal axes of, and being aligned with, the inner channels.

A building, in accordance with one embodiment, includes a roof and at least one of the aforementioned vents coupled to the roof.

A method, according to one embodiment, includes installing one or more of the aforementioned vents on a building.

DETAILED DESCRIPTION

Figure 1:
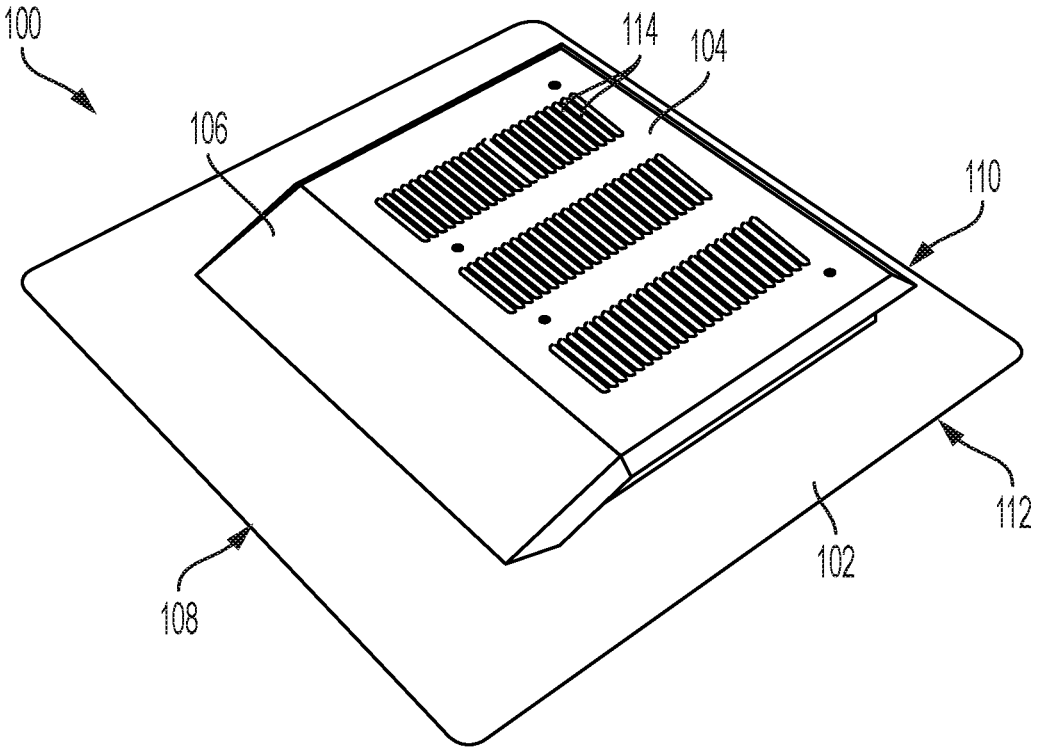
FIG. 1 is a perspective view of a vent, in accordance with one embodiment.
Figure 2:
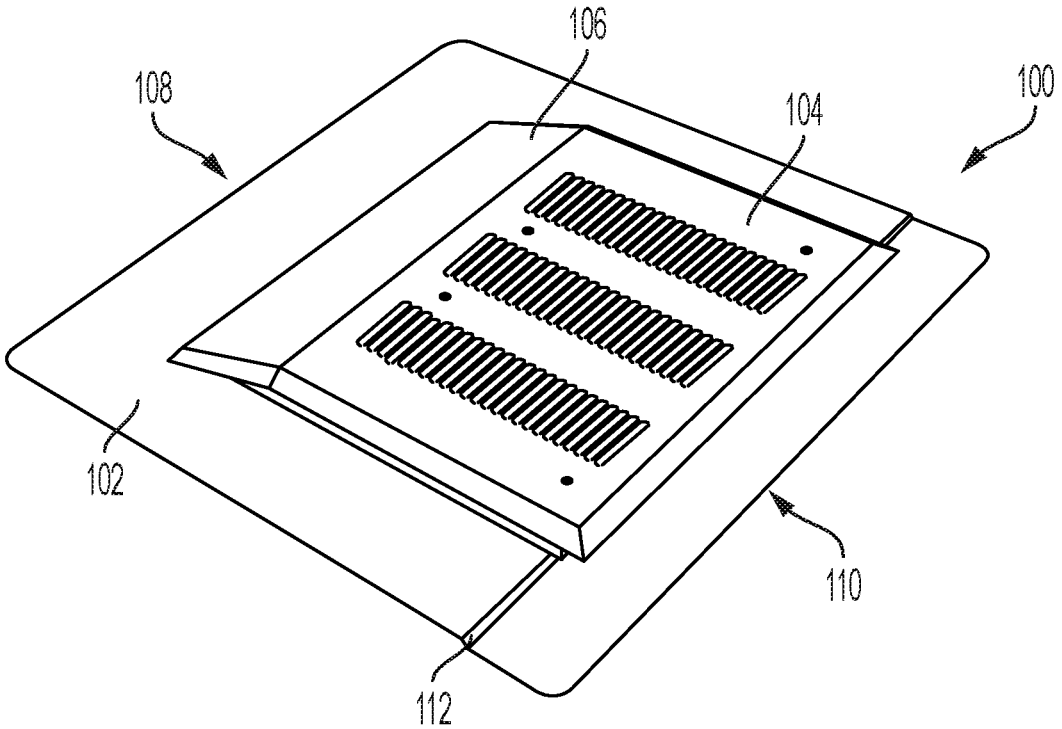
FIG. 2 is a perspective view of the vent of FIG. 1, in accordance with one embodiment.
Figure 3:
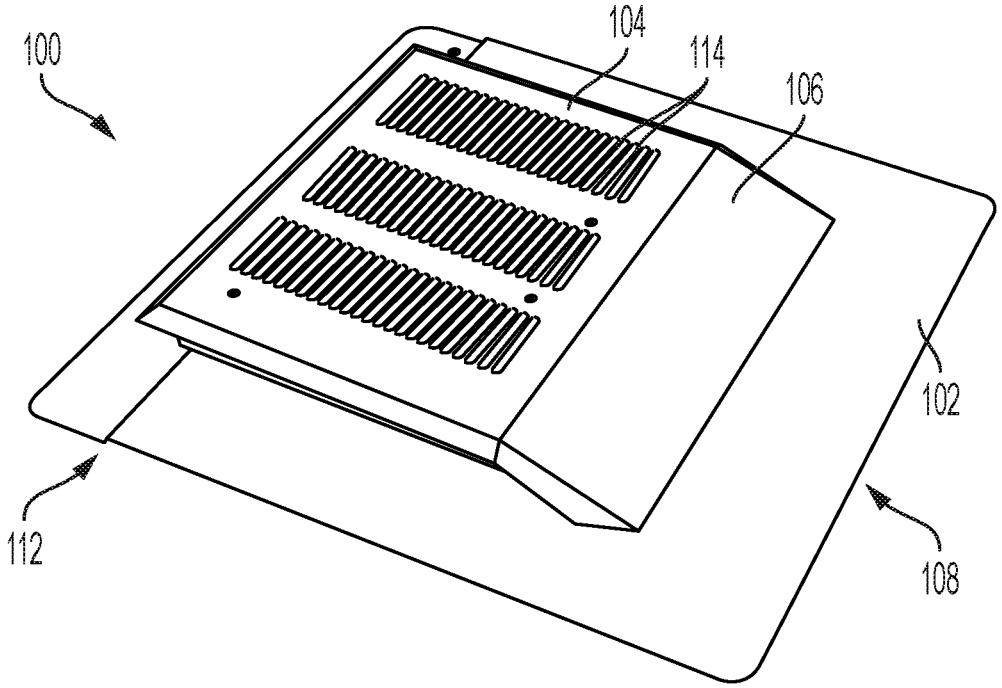
FIG. 3 is a perspective view of the vent of FIG. 1, in accordance with one embodiment.
Figure 4:
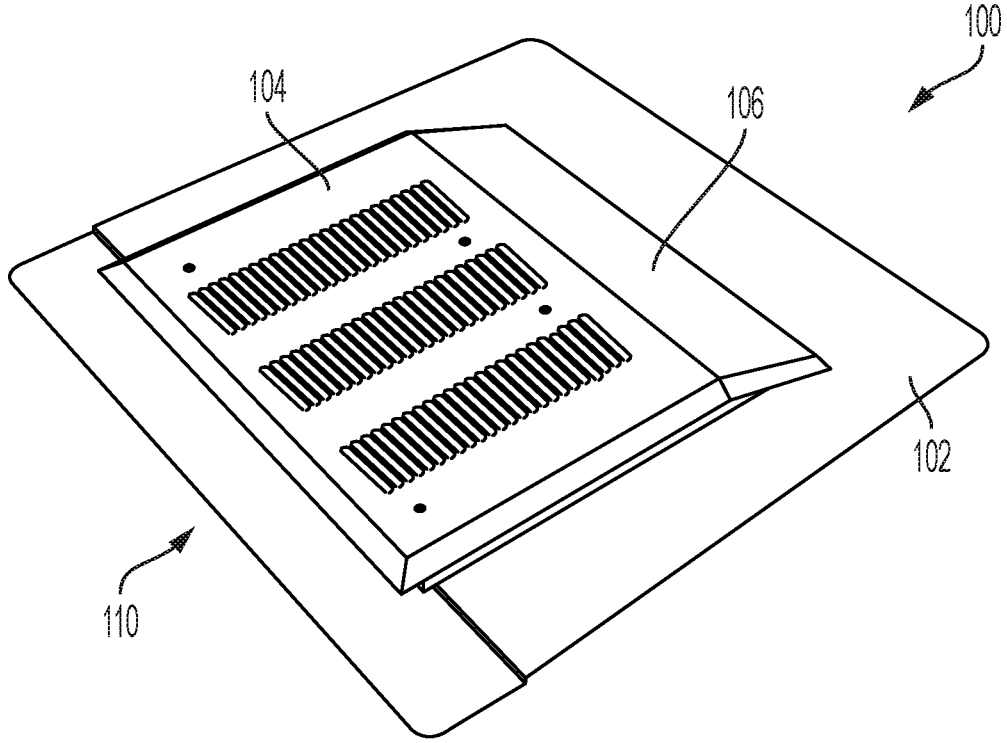
FIG. 4 is a perspective view of the vent of FIG. 1, in accordance with one embodiment.
Figure 5:
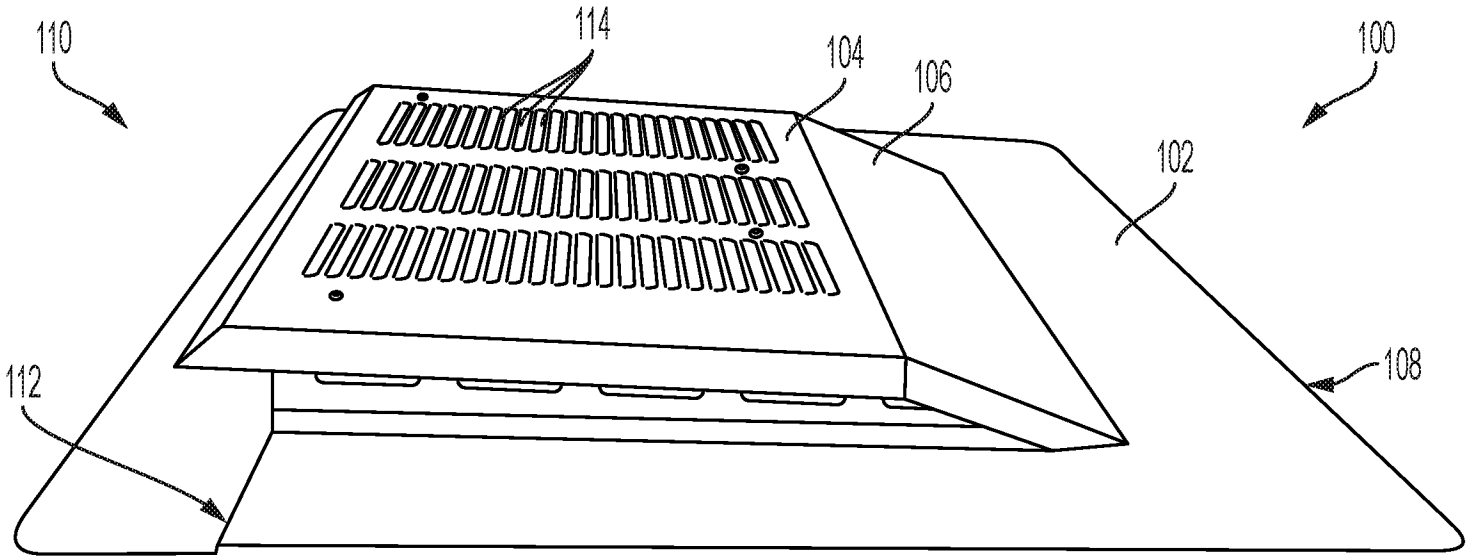
FIG. 5 is a perspective view of the vent of FIG. 1, in accordance with one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred embodiments of vents that provide excellent ventilation while providing near 100% water intrusion resistance.

Note that while exemplary embodiments are described below, the number of any part, the dimensions of any part, the angle and/or orientation of any part, etc. of the vents described herein may be selected in consideration of variables such as desired airflow, desired vent profile height, etc., as would become apparent to one skilled in the art once apprised of the present disclosure.

FIGS. 1-9 are perspective and side views of a vent 100, in accordance with one embodiment. As an option, the present vent may be implemented in conjunction with features from any other embodiment listed herein, such as those described with reference to the other FIGS. Of course, however, such vent and others presented herein may be used in various applications and/or in permutations which may or may not be specifically described in the illustrative embodiments listed herein. Further, the vent presented herein may be used in any desired environment.

As shown, the vent includes a lower panel 102, an upper panel 104, and a face panel 106 extending from the lower panel 102 to the upper panel 104.

On a sloped roof, the front edge 108 of the lower panel 102 would be installed upward to face the peak of the roof, while the back edge 110 would face the lower edge of the roof. The lower panel 102 may include a feature 112 to allow water running along the vent toward the back edge 110 to transition to another portion of the roof without intruding the structure. Any type of feature 112 that would become apparent to one skilled in the art upon reading the present disclosure may be used. For example, the feature 112 may include a Pittsburgh seam designed to overlap a shingle overlying the back end of the lower panel 102 to transition running water to the shingle. Other illustrative features include standing seams, hem seams, lap seams, etc.

Note that the dimensions of the lower panel 102 as shown are larger than the dimensions of the upper panel 104, but this is not necessary, i.e., one or more dimensions of the upper panel 104 may be larger than the lower panel 102 in some approaches. In the example shown, the length of the lower panel 102 between the front and back edges thereof is greater than a length of the upper panel 104 as measured in the same direction. Likewise, the width of the lower panel 102 as measured perpendicular to the length of the lower panel 102 is greater than the width of the upper panel 104 as measured in the same direction. Nonetheless, the dimensions of the lower panel 102 are preferably large enough to shield the components (described below) located under the upper panel 104 from rain but small enough to avoid parachuting action from wind.

Note also that edges of the upper panel 104 may be angled, e.g., downward as shown, to reduce occurrence of driving rain reaching the components located under the upper panel 104. The edges of the upper panel 104 may be angled downwardly at any desired angle relative to the plane of the top surface of the upper panel 104, with preferred angling being at least about 10°, more preferably at least about 20°, and ideally between about 25° and 45°.

Preferably, the periphery of the lower panel 102 extends far enough from the components located under the upper panel 104 to ensure good waterproofing.

The dimensions of the upper and lower panels can be any desired length. An illustrative width of the lower panel 102 along the front edge 108 thereof is less than about 36 inches, but could be higher for larger deployments. An illustrative length of the lower panel 102, measured perpendicular to the front edge 108 thereof, is less than about 36 inches, but could be higher for larger deployments. An illustrative spacing between the panels is less than about 6 inches, more preferably less than about 4 inches to maintain a lower profile, and in some approaches less than about 3 inches.

The face panel 106 is shown angled relative to the plane of the lower panel 102, rather than aligned therewith or orthogonal thereto. In preferred embodiments, the face panel 106 is tilted from said plane by an angle in a range of greater than 0° to less than 90°, and more preferably at an angle of less than about 45°. However, in some approaches, the face panel 106 may be perpendicular to said plane.

As represented by the marks on the upper panel 104, the upper panel 104 includes arrays of apertures 114 that provide ventilation through the upper panel 104. As described in more detail below, water traversing the apertures 114 is not able to traverse through the lower panel 102 into an underlying structure due to the unique design of the components located under the upper panel 104 that channel the water out of the rear of the vent.

The apertures 114 are preferably created by punching louvers into the upper panel 104 (e.g., see FIGS. 10-11), but can be apertures 114 of any type (e.g., holes, punchouts, etc.), and formed by any method, that would become apparent to one skilled in the art upon reading the present disclosure. The louvers may be made to extend upward from the upper panel 104 to enhance air flow, e.g., to catch wind and/or to create mild suction from wind passing thereover.

The apertures 114 may have any desired size, arrangement, type, peripheral shape, etc. Any number of apertures 114 may be present. Moreover, combinations of apertures 114 having differing aperture size, shape, type and/or orientation are provided in various embodiments. In general, the larger the cumulative area of the apertures 114, the more air is allowed to pass through the upper panel 104.

In one illustrative approach having three rows (arrays) of apertures 114 as shown, the longitudinal length of each of the apertures 114 may be less than about 6 inches. However, the preferred lengths of the apertures 114 are about as wide as a distance between the top ends of the walls 120 (described below with reference to FIG. 7) so that a majority of any water coming through the apertures 114 falls into the outer channels 124 between the walls 120. Thus, the preferred lengths of the apertures 114 are as wide as, slightly wider than, or slightly less wide than the distance between the top ends of the barriers 128.

Illustrative widths of the openings as measured perpendicular to the later openings is preferably less than 1 inch, and in some approaches less than ½ inch.

When louvers are used, the angle of some or preferably all of the louvers relative to a plane of the surface from which the louver extends may be any angle between 0° and 90°. In preferred approaches, the angle is less than about 70°, and in preferred approaches between 50° and 70°, to balance resistance to water intrusion with airflow therethrough.

The longitudinal orientations of the apertures 114 can be in any desired direction. As shown, the apertures 114 are arranged laterally in three rows with longitudinal axes thereof extending parallel to the front edge 108 of the lower panel 102. This orientation of louvers provides the best resistance to water intrusion, as the majority of water (e.g., rain) falling onto the vent will tend to run around the apertures 114, and off the back edge 110 of the vent. However, in other approaches, the apertures 114 could be arranged in a different direction, e.g., orthogonally to the direction shown, angled, etc.

Figure 6:
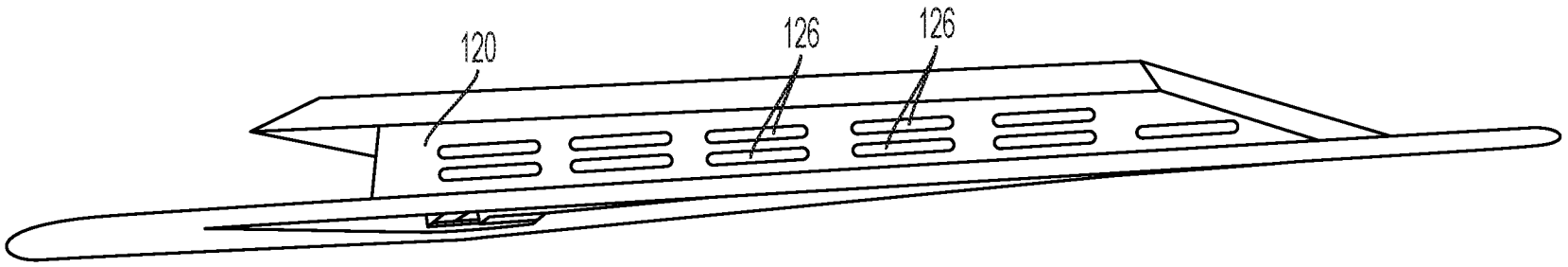
FIG. 6 is a side view of the vent of FIG. 1, in accordance with one embodiment.
Figure 7:
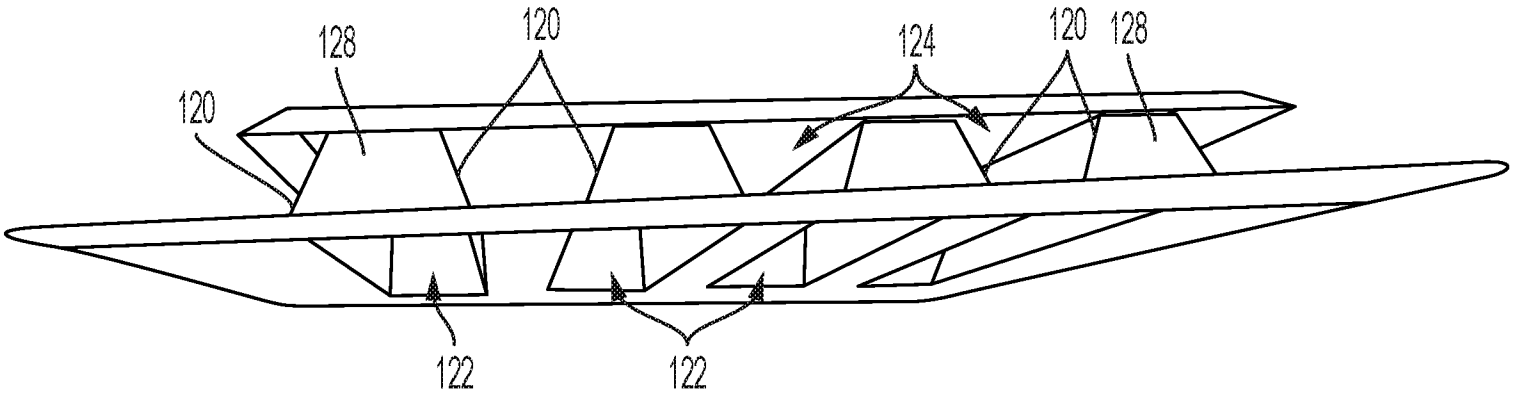
FIG. 7 is a perspective view of the vent of FIG. 1, in accordance with one embodiment.

Referring to FIGS. 6-7, the components under the upper panel 104 include a series of walls 120 that define inner channels 122 and outer channels 124. As shown, the outer channels 124 are generally positioned below and vertically aligned with the rows of apertures 114 in the upper panel 104; and the longitudinal axes of the outer channels 124 extend along the longitudinal axes of the rows of apertures 114 in the upper panel 104. The outer channels 124 are open to the atmosphere via the aforementioned apertures 114 in the upper panel 104. The inner channels 122 are designed to be open to the interior of the structure on which installed, e.g., open to an attic of a building, thereby enabling airflow between the environment and the interior of the structure via the apertures 114, openings 126, and inner channels 122.

The walls 120 have openings 126 therein that allow air to pass through the walls 120 between the adjacent channels. Preferably, the openings 126 are configured to resist water flow through the openings 126. Louvers are preferred openings 126, with the louver blades extending into the outer channel in a generally downward direction to urge water contacting the blades to run off toward the center of the respective outer channel, and out the back of the vent. As noted above, louvers may be formed by punching the walls 120 to create blades that extend at an angle from the walls 120, thereby creating a hole for air to pass through. See also FIG. 12, which depicts louver-type openings 126. Other types of openings 126 may be used as well, as would become apparent to one skilled in the art upon reading the present disclosure. For example, smaller perforations may be used in one approach; however, louvers provide better airflow than smaller perforations.

The openings 126 are positioned a distance above the bottom of the associated outer channel so that water coming through the apertures 114 in the upper panel 104 drains out the back of the outer channels 124 (see FIG. 7) without traversing the openings 126 in the walls 120. Said distance is preferably at least ⅛ inch, and ideally at least ¼ inch or greater.

The openings 126 may have any desired size, arrangement, type, peripheral shape, etc. Any number of openings 126 may be present. Moreover, combinations of openings 126 having differing size, shape, type and/or orientation are provided in various embodiments. In general, the larger the cumulative area of the openings 126, the more air is allowed to pass through the walls 120. Illustrative dimensions of the openings 126 are less than about 12 inches in longitudinal length by less than about 1 inch, but could be longer or shorter in various approaches. In preferred embodiments, the longitudinal lengths of the louvers are less than about 6 inches.

The longitudinal orientations of the openings 126 can be in any desired direction. As shown, the openings 126 are arranged longitudinally along the walls 120 in two rows per wall. However, in other approaches, the openings 126 could be arranged in a different direction, e.g., orthogonally to the direction shown, angled, etc. Moreover, a single row of openings 126 may be used, or more than two rows of openings 126 may be present. When louvers are used as the openings 126, the angle of the louver relative to a plane of the surface from which the louver extends may be any angle between 0° and 90°. In preferred approaches, the angle is less than about 60°, and in some approaches between 33° and 60° to balance resistance to water intrusion with airflow therethrough.

The walls 120 may be angled from the plane of the lower panel 102 in a range of between 10° and 90°. Preferably, the angle of the walls 120 is greater than 45° and less than 90° to balance water intrusion resistance with surface area available for the holes. As shown in FIG. 7, the pairs of opposing walls 120 that form the outer channels 124 preferably taper apart toward the upper panel 104. Thus, conversely, the pairs of opposing walls 120 that form the inner channels 122 taper together toward the upper panel 104.

The number of walls 120 may be any desired number, e.g., to provide more or less channels than those shown. Moreover, the dimensions of the walls 120 may be any desired dimension. For example, a higher wall would allow for more openings 126 therein, and thus more airflow thereacross. A lower wall provides a lower profile for the vent. Accordingly, the number and the dimensions of the walls 120, and likewise the number and the dimensions of any other part of the vent, may be selected in consideration of variables such as desired airflow, desired vent profile height, etc., as would become apparent to one skilled in the art once apprised of the present disclosure.

Figure 8:
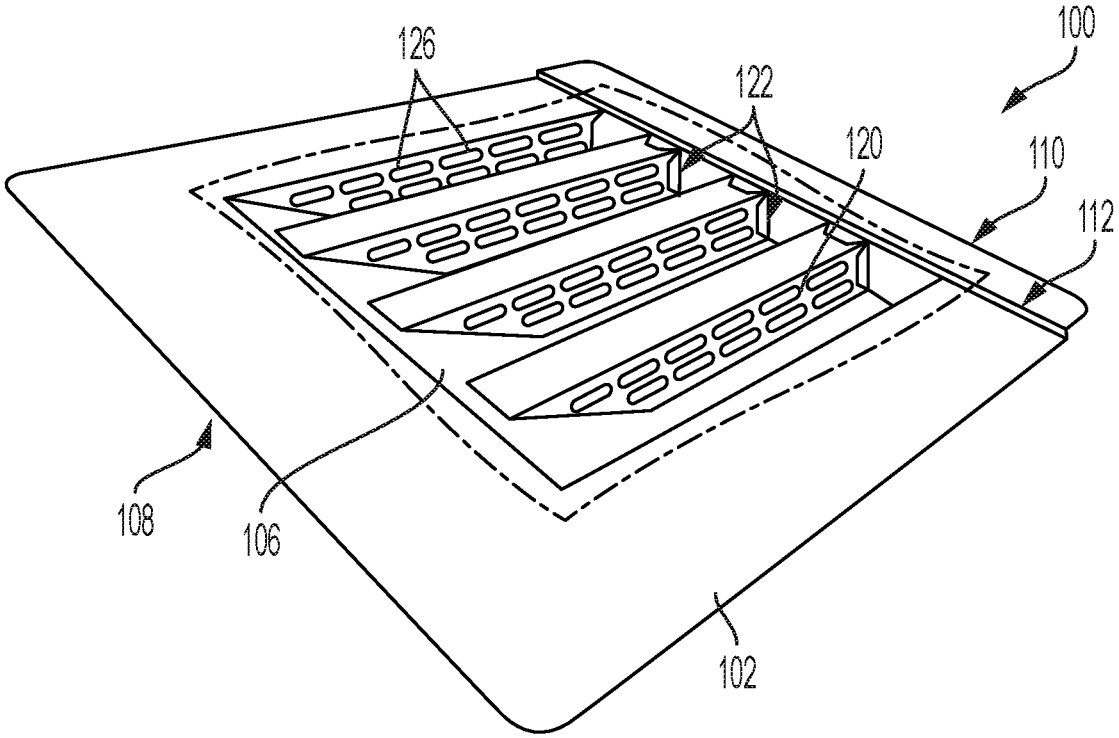
FIG. 8 is a partial perspective view, with cutaway, of a bottom of the vent of FIG. 1, in accordance with one embodiment.
Figure 9:
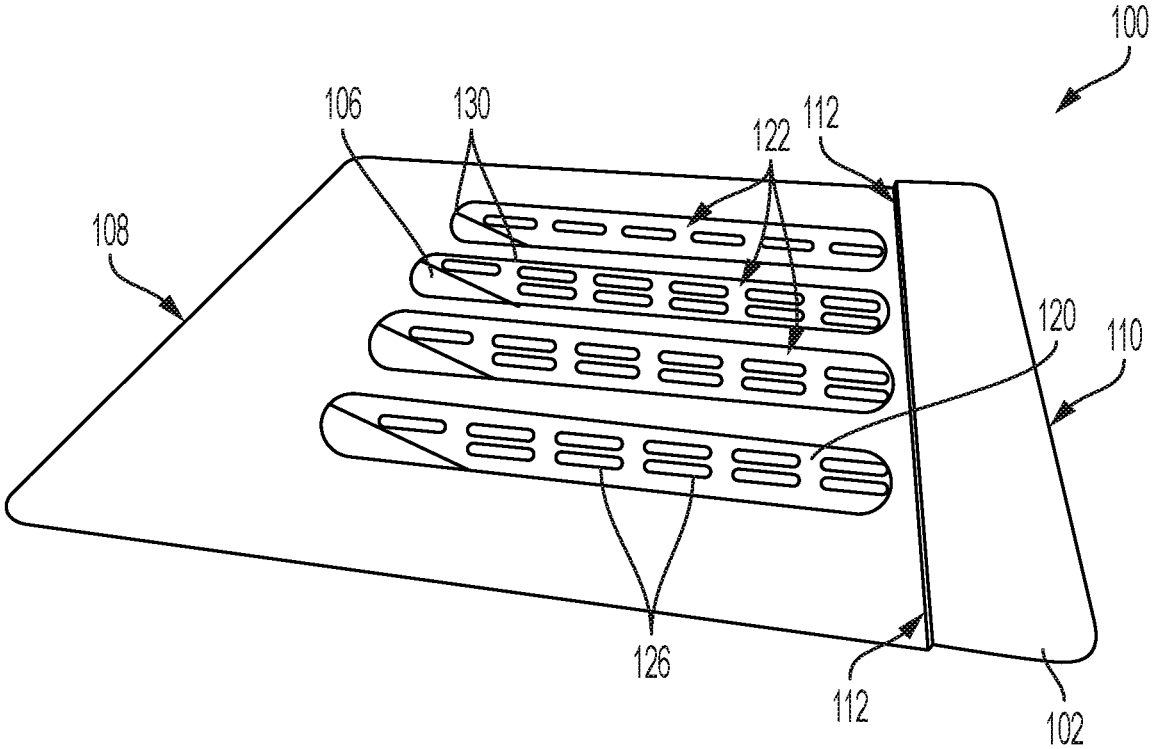
FIG. 9 is a perspective view of the bottom of the vent of FIG. 1, in accordance with one embodiment.

The front and back ends of the inner channels 122 are preferably closed off to avoid water ingress through said ends. As shown in FIG. 7, a barrier 128 may be positioned toward the back end of some or all of the inner channels 122, e.g., to prevent wind from pushing rain into the inner channel, keep animals out of the inner channel, etc. Moreover, as shown in FIGS. 8-9, which depict the bottom of the vent, the face panel 106 may at least partially close off the front ends of the inner channels 122. Of particular note, FIG. 9 illustrates airflow holes 130 that extend along and are generally vertically aligned with longitudinal axes of the inner channels 122. See the description of FIG. 13, below for more details about the airflow holes 130.

Additional features may be included in the vent without straying from the spirit and scope of the present invention. For example, a screen may be provided in any desired location to prevent insects, birds, leaves, etc. from entering the building via the vent. For example, a screen may be located along the apertures 114 in the upper panel 104, along the holes in the walls 120, along the plane of the lower panel 102, across an airflow hole in the lower panel 102, etc.

Figure 10:
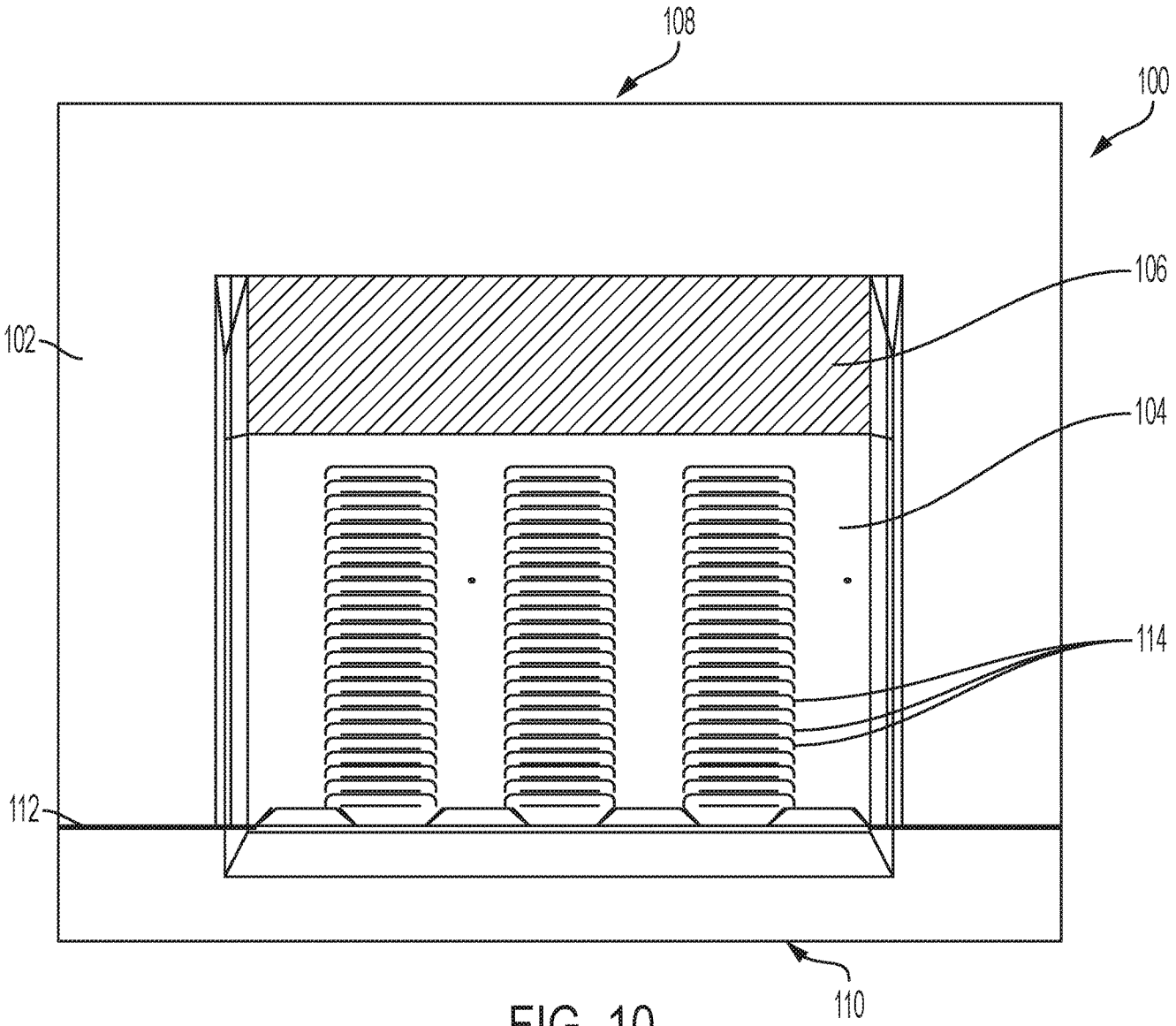
FIG. 10 is a top down view of a vent, in accordance with one embodiment.
Figure 11:
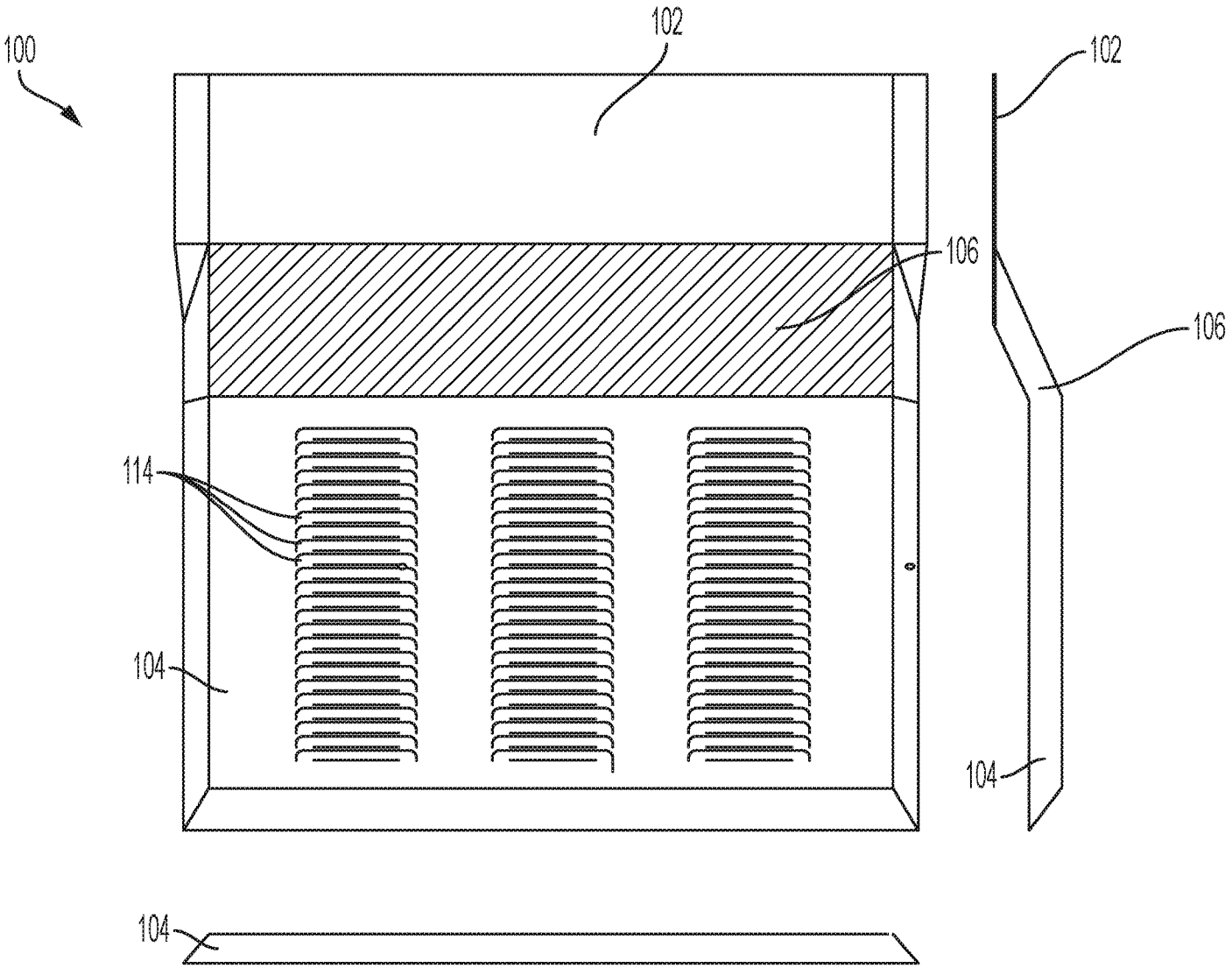
FIG. 11 are partial top down, partial side, and partial rear views of the vent of FIG. 10, in accordance with one embodiment.
Figure 12:
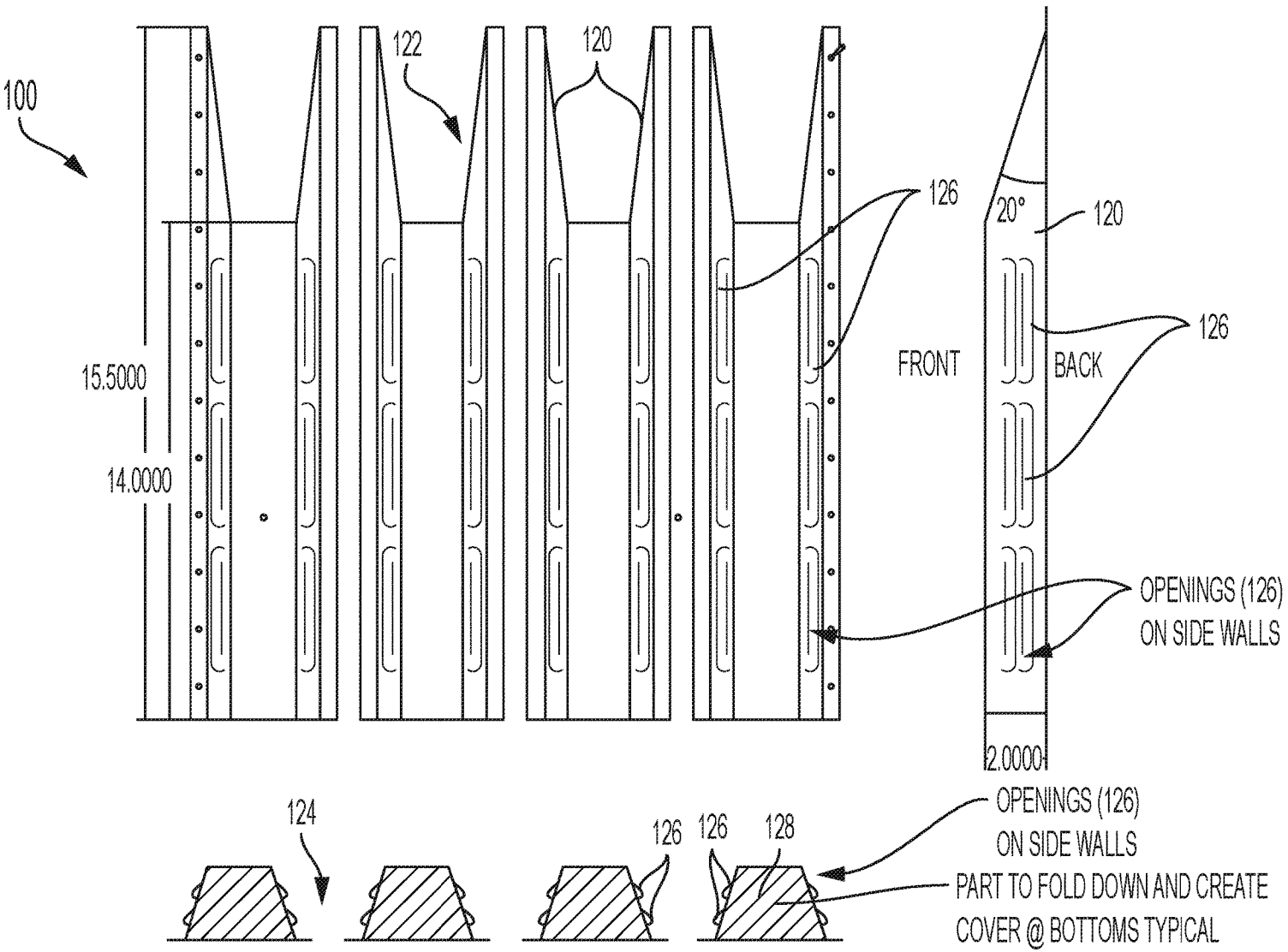
FIG. 12 are partial top down, partial side, and partial rear views of the vent of FIG. 10, in accordance with one embodiment.
Figure 13:
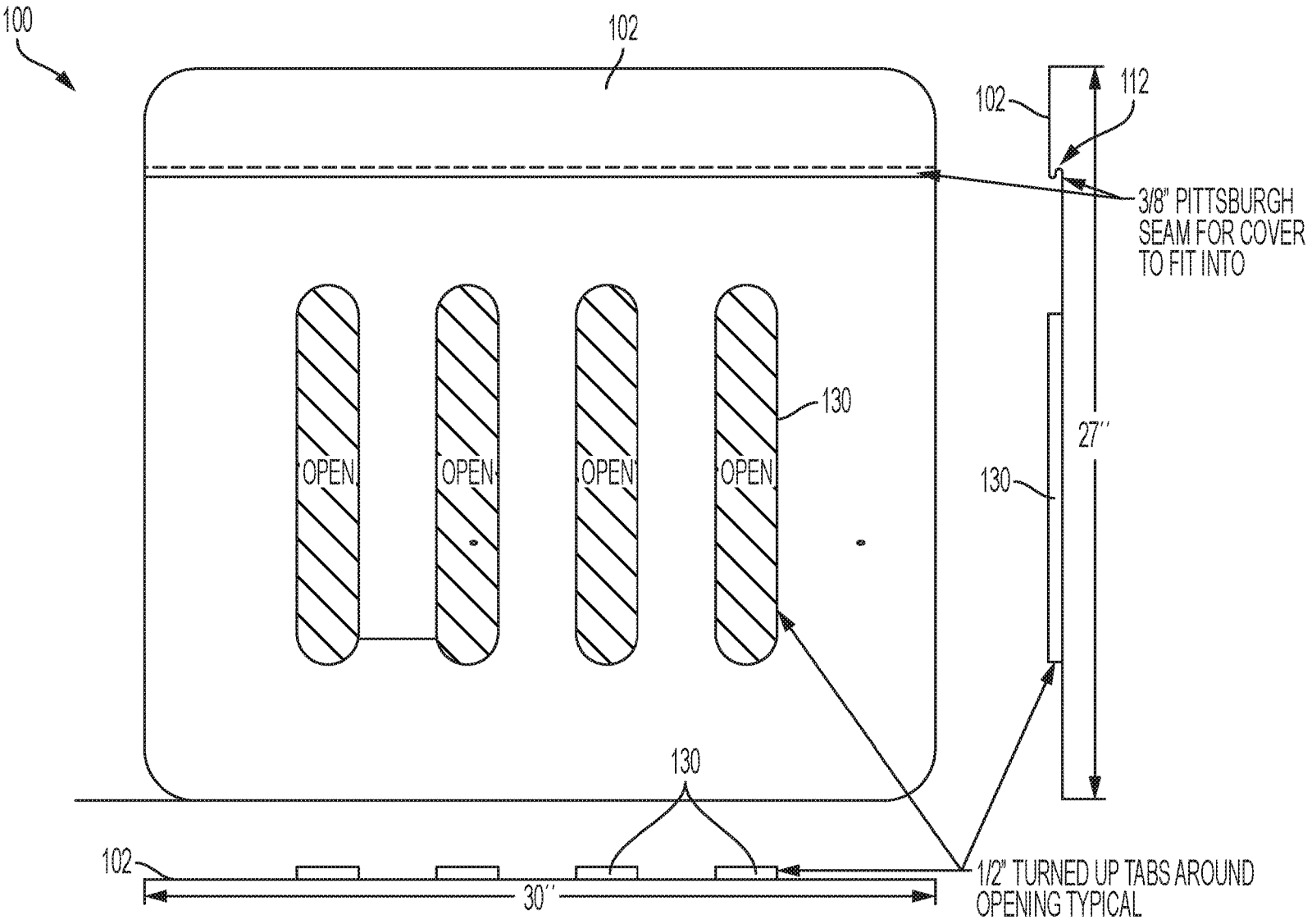
FIG. 13 are bottom, side, and rear views of the lower panel of the vent of FIG. 10, in accordance with one embodiment.

FIG. 10 depicts a top view of a vent 100, in accordance with one embodiment. FIG. 11 depicts a partial top view of the vent 100 of FIG. 10. FIG. 12 depicts a partial internal view of the vent 100 of FIG. 10. FIG. 12 depicts a partial internal view of the vent 100 of FIG. 10. FIG. 13 depicts a partial internal view of the vent 100 of FIG. 10. As an option, the present vent 100 may be implemented in conjunction with features from any other embodiment listed herein, such as those described with reference to the other FIGS, and therefore FIGS. 10-13 share common numbering for common parts, including those shown in FIGS. 1-9 and 14-17. Of course, however, such vent 100 and others presented herein may be used in various applications and/or in permutations which may or may not be specifically described in the illustrative embodiments listed herein. Further, the vent 100 presented herein may be used in any desired environment.

FIGS. 11-13, which each include a plan, side, and end view of a portion of the vent, include exemplary dimensions in inches, as well as angles. This has been done by way of example only to depict an embodiment having very close to the maximum amount of air flow and water intrusion resistance for the volume of the vent structure. Moreover, the angles shown are suitable for a standard 3:12 roof slope, or steeper. Regardless, the dimensions selected by one skilled in the art upon practicing embodiments of the present invention may vary from the dimensions and angles shown.

Of particular note, FIG. 13 illustrates airflow holes 130 that extend along and are generally vertically aligned with longitudinal axes of the inner channels 122. Preferably, the airflow holes 130 have raised edges along peripheries thereof that extend toward the upper panel 104. The raised edges can have any desired height, e.g., at least ¼ inch high, preferably at least ½ inch high, to prevent any water reaching the lower panel 102 from entering the airflow holes 130. Preferably, the raised edges are less than about 1 inch high to minimize obstruction to airflow while providing adequate water intrusion resistance. Illustrative dimensions of the airflow holes 130 are less than about 30 inches by less than about 6 inches, but any of these dimensions could be longer and/or shorter in various approaches.

Figure 14:
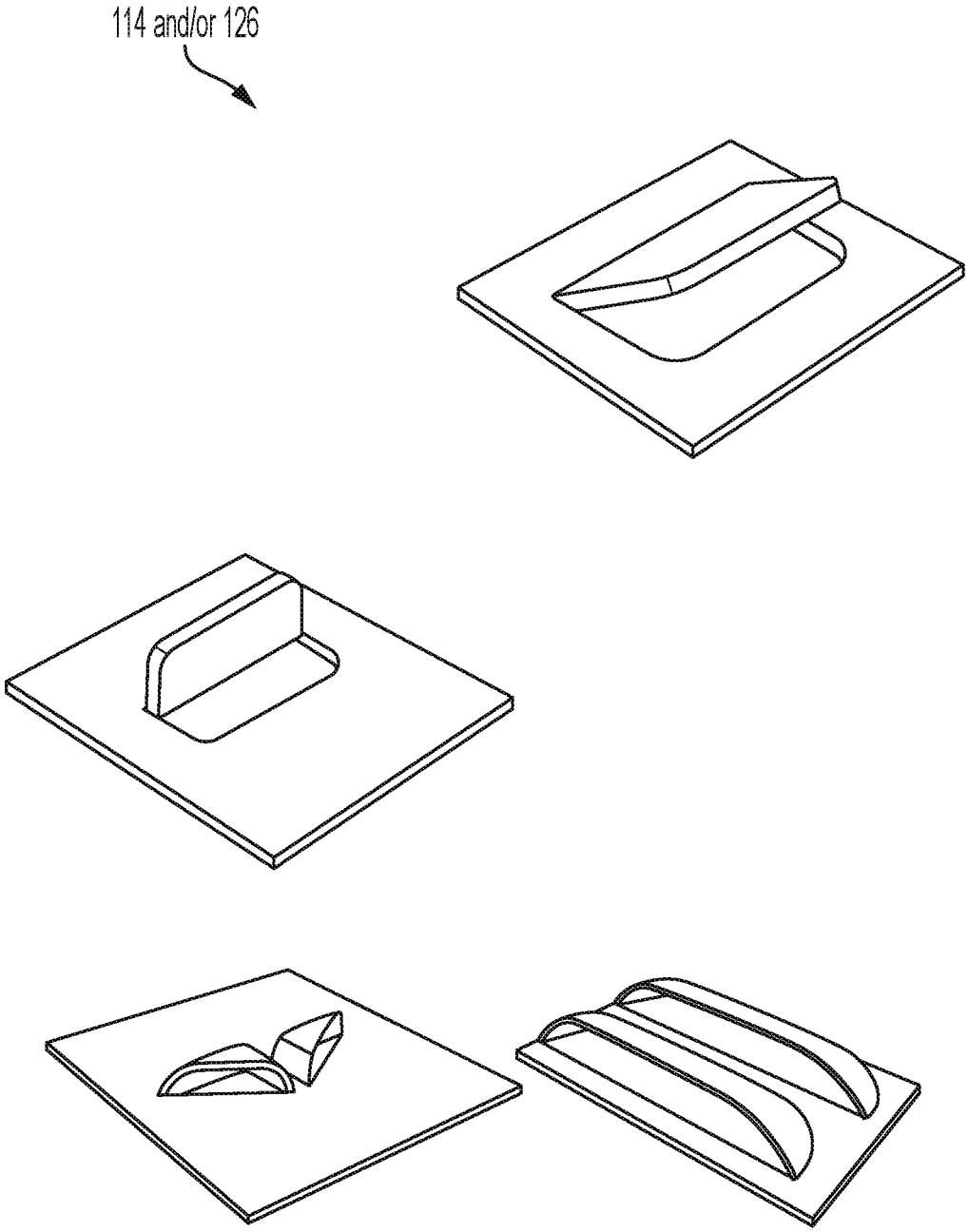
FIG. 14 are perspective views of louvers, in accordance with various embodiments.

FIG. 14 illustrates several potential louver shapes, that may be used for the apertures 114 and/or openings 126 described herein.

The various components of the vents described herein may be constructed in any desired configuration that would become apparent to one skilled in the art upon reading the present disclosure. For example, one or more of the panels may be of unitary construction, formed of multiple sub-panels, etc.

In some aspects, two or more of the panels described may be portions of a single larger panel; and in some cases, only a portion of a panel may be part of the larger panel. For example, as shown in FIG. 1, the upper and face panels 104, 106 are portions of a single larger panel, and the single larger panel also includes the middle-front portion of the lower panel 102. This approach minimizes seams to improve water resistance.

Figure 15:
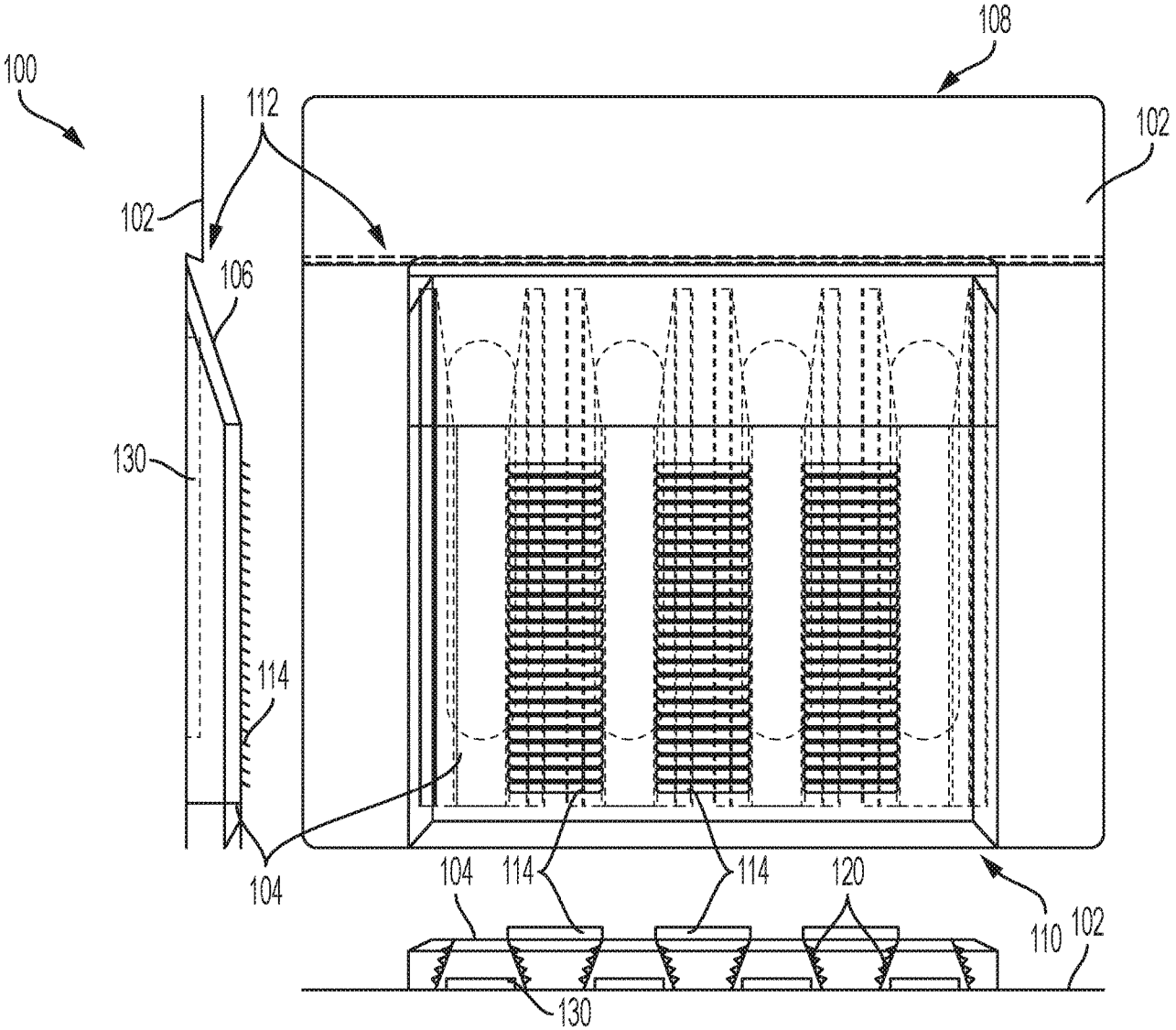
FIG. 15 are top, side, and rear views of a vent, in accordance with one embodiment.
Figure 16:
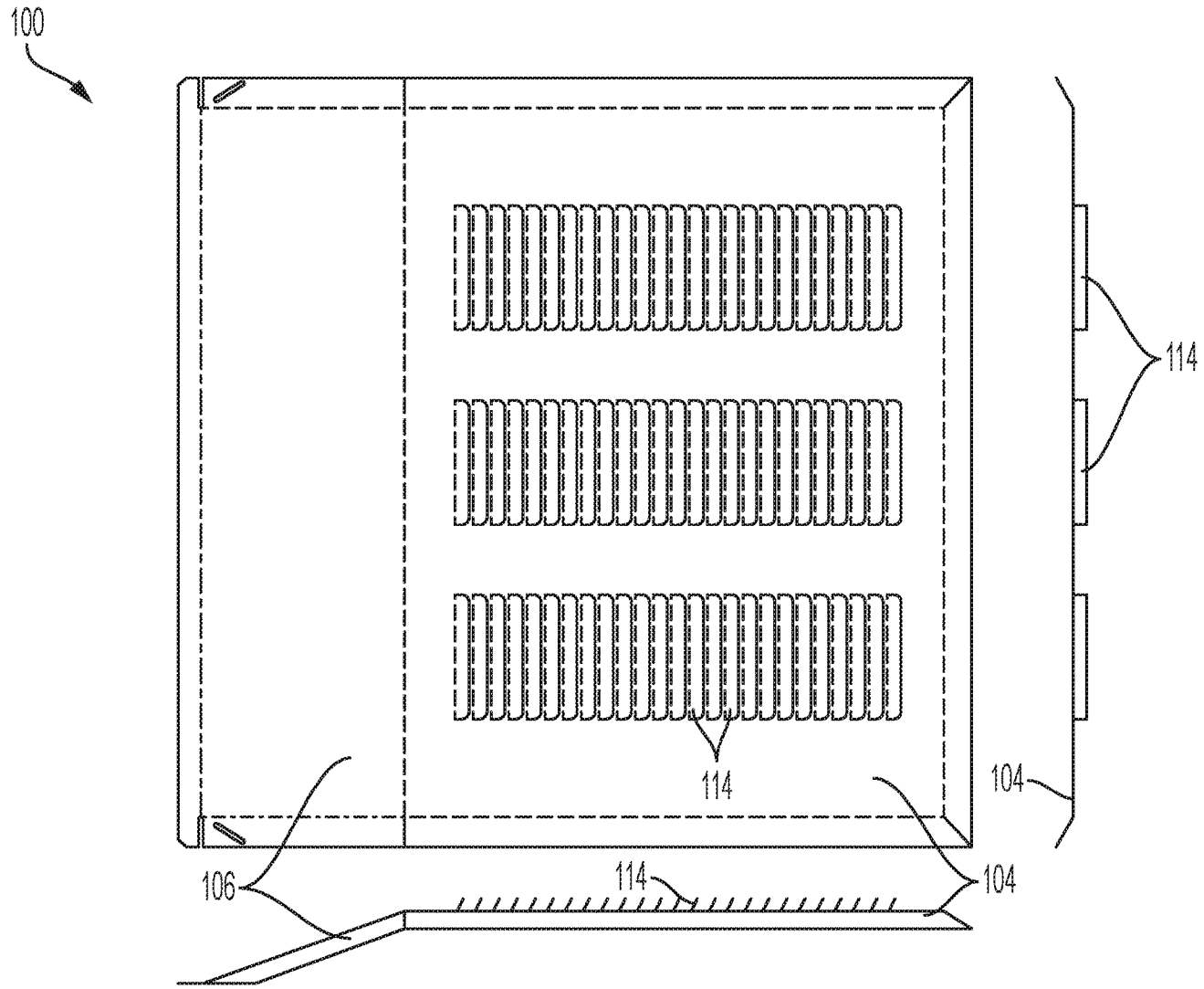
FIG. 16 are partial top, side, and rear views of the upper and face panels of the vent of FIG. 15, in accordance with one embodiment.
Figure 17:
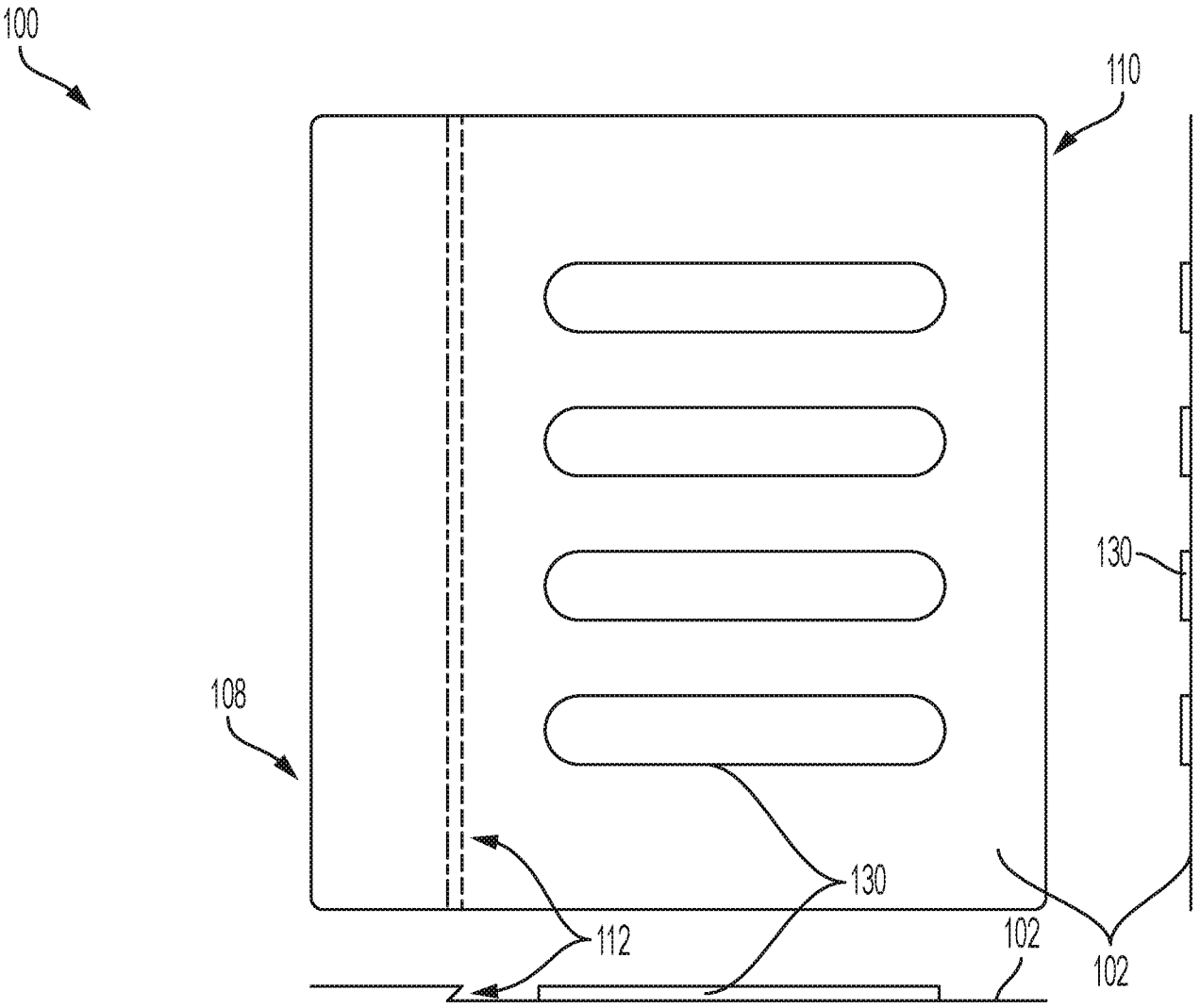
FIG. 17 are partial top, side, and rear views of the lower panel of the vent of FIG. 15, in accordance with one embodiment.

FIG. 15 depicts top, side, and rear views of a vent 100, in accordance with another embodiment. FIG. 16 depicts partial top, side, and rear views of the upper and face panels of the vent 100 of FIG. 15. FIG. 17 depicts partial top, side, and rear views of the lower panel of the vent 100 of FIG. 15. As an option, the present vent 100 may be implemented in conjunction with features from any other embodiment listed herein, such as those described with reference to the other FIGS, and therefore FIGS. 15-17 share common numbering for common parts, including those shown in FIGS. 1-14. Of course, however, such vent 100 and others presented herein may be used in various applications and/or in permutations which may or may not be specifically described in the illustrative embodiments listed herein. Further, the vent 100 presented herein may be used in any desired environment.

FIGS. 15-17, which each include a plan, side, and end view of a portion of the vent, include exemplary dimensions in inches, as well as angles. This has been done by way of example only to depict an embodiment having very close to the maximum amount of air flow and water intrusion resistance for the volume of the vent structure. Moreover, the angles shown are suitable for a standard 3:12 roof slope, or steeper. Regardless, the dimensions selected by one skilled in the art upon practicing embodiments of the present invention may vary from the dimensions and angles shown.

Of particular note, the feature 112 has been moved toward the front edge 108 of the vent 100. Also, the rear edge 110 of the vent 100 has been shortened.

The various components of the vents described herein may be constructed of any desired material, such as metal, plastic, etc., with weather resistant and corrosion resistant materials being preferred. Particularly preferred materials include galvanized metal (e.g., galvanized steel), aluminum, and stainless steel. Preferably, where galvanized metal is used, it is at least 26 gauge. In other approaches, the material may be painted, sealed, etc.

The various components of the vents described herein may be coupled to one another in any manner that would become apparent to one skilled in the art upon reading the present disclosure. Examples include spot welding, seam welding, rivets, screws, adhesives, etc. in any combination.

A method according to one embodiment includes installing a vent having any combination of features described herein on a building. In one exemplary process, the vent is coupled to the building during installation of a roof. Preferably, other roofing materials such as tar paper, shingles, metal panels, flashing, sealant (e.g., tar, caulk, adhesive, or the like), etc. is installed in an otherwise conventional manner along with the vent so as to create a watertight seal along at least the periphery of the lower panel of the vent. Typically, other roofing materials would overlap at least some of the lower panel, preferably at least along the front and the sides of the vent.

The vent itself may be coupled to the building on which installed in any suitable manner, e.g., using nails, screws, adhesives, etc. For example, the lower panel may be nailed and/or screwed down to the roofing joists and/or plywood roof underlayment.

Note also that to provide airflow into and/or out of the building, the inner channels 122 should be open to the interior of the building, e.g., the attic.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A vent, comprising: a lower panel having a front edge and a back edge;

an upper panel spaced from the lower panel, the upper panel having at least one array of apertures therethrough;

a face panel extending between the lower and upper panels in a direction from the front edge of the lower panel toward the back edge of the lower panel;

and walls extending between the lower and upper panels, the walls defining inner channels and outer channels therebetween, the walls having openings therein;

wherein the lower panel includes at least one airflow hole therethrough, the airflow hole extending along and being generally aligned with longitudinal axes of the inner channels, wherein the openings include louvers extending upward from the upper panel.

2. A vent as recited in claim 1, wherein a length of the lower panel between the front and back edges thereof is greater than a length of the upper panel as measured in the same direction, wherein a width of the lower panel as measured perpendicular to the length thereof is greater than a width of the upper panel as measured in the same direction.

3. A vent as recited in claim 1, wherein the face panel is angled at an angle of less than 45° relative to a plane of the lower panel.

4. A vent as recited in claim 1, wherein the apertures include louvers extending upward from the upper panel.

5. A vent as recited in claim 4, wherein an angle of at least some of the louvers relative to a plane of a surface of the upper panel from which the louvers extend is less than 70°.

6. A vent as recited in claim 1, wherein the lower panel includes a feature toward the back edge thereof to allow water running along the vent toward the back edge to transition to another portion of a roof.

7. A vent as recited in claim 1, wherein at least two edges of the upper panel are angled downward at an angle of at least 10° relative to a plane of a top surface of the upper panel.

8. A vent, comprising:

a lower panel having a front edge and a back edge;

an upper panel spaced from the lower panel, the upper panel having at least one array of apertures therethrough;

a face panel extending between the lower and upper panels in a direction from the front edge of the lower panel toward the back edge of the lower panel; and walls extending between the lower and upper panels, the walls defining inner channels and outer channels therebetween, the walls having openings therein;

wherein the lower panel includes at least one airflow hole therethrough, the airflow hole extending along and being generally aligned with longitudinal axes of the inner channels, wherein at least two arrays of apertures are present, wherein each of the outer channels is positioned below a respective one of the arrays of apertures, wherein a longitudinal axis of each of the outer channels extends along a longitudinal axis of the associated array of apertures.

9. A vent as recited in claim 1, wherein an angle of at least some of the louvers relative to a plane of a surface of the wall from which the louvers extend is less than 60°.

10. A vent, comprising:

a lower panel having a front edge and a back edge;

an upper panel spaced from the lower panel, the upper panel having at least one array of apertures therethrough;

a face panel extending between the lower and upper panels in a direction from the front edge of the lower panel toward the back edge of the lower panel;

walls extending between the lower and upper panels, the walls defining inner channels and outer channels therebetween, the walls having openings therein; and a barrier positioned toward a back end of at least some of the inner channels, wherein the lower panel includes at least one airflow hole therethrough, the airflow hole extending along and being generally aligned with longitudinal axes of the inner channels.

11. A vent as recited in claim 1, wherein the face panel is positioned and angled to at least partially close off front ends of the inner channels.

12. A vent as recited in claim 1, wherein pairs of opposing walls that define the outer channels taper apart toward the upper panel.

13. A vent as recited in claim 1, wherein the airflow hole has a raised edge along a periphery thereof, the airflow hole extending from the lower panel toward the upper panel.

14. A vent as recited in claim 1, comprising a screen extending along a component of the vent, the component being selected from the group consisting of: the apertures in the upper panel, the holes in the walls, the airflow hole, and the lower panel.

15. A building, comprising a roof and at least one vent as recited in claim 1 coupled to the roof.

16. A method, comprising:

installing the vent as recited in claim 1 on a building.

17. A vent, comprising:

a lower panel having a front edge and a back edge;

an upper panel spaced from the lower panel, the upper panel having arrays of apertures therethrough aligned in rows, the rows extending in a direction between the front and back edge of the lower panel;

a face panel extending between the lower and upper panels in the direction from the front edge of the lower panel toward the back edge of the lower panel; and walls extending between the lower and upper panels, the walls defining inner channels and outer channels therebetween, the walls having openings therein, wherein the outer channels are positioned below and are aligned with the arrays of apertures, wherein longitudinal axes of the outer channels extend along longitudinal axes of the arrays of apertures, wherein the lower panel includes airflow holes therethrough, the airflow holes extending along longitudinal axes of, and being aligned with, the inner channels.

18. A vent as recited in claim 17, wherein the airflow holes have raised edges along peripheries thereof, the airflow holes extending from the lower panel toward the upper panel.

19. A vent as recited in claim 17, comprising barriers positioned toward back ends of the inner channels.

* * * * *